US006116870A

United States Patent [19]

Kraemer

[11] Patent Number: 6,116,870

[45] Date of Patent: Sep. 12, 2000

[54] HIGH PRESSURE PUMP WITH SOLENOID OPERATED VALVE

[75] Inventor: Manfred Kraemer, Schwieberdingen, Germany

[73] Assignee: Robert Bosch GmbH, Stuttgart, Germany

[21] Appl. No.: 08/960,575

[22] Filed: Oct. 29, 1997

[30] Foreign Application Priority Data

Oct. 29, 1996 [DE] Germany ..... 196 44 915

[51] Int. Cl.[7] ..... F04B 7/04; F04B 39/08

[52] U.S. Cl. ..... 417/490; 417/505; 417/503

[58] Field of Search ..... 417/490, 503, 417/505, 510, 571, 440; 123/500, 506, 458

[56] References Cited

U.S. PATENT DOCUMENTS

| | | | |
|---|---|---|---|
| 5,286,178 | 2/1994 | Schaef | 417/490 |
| 5,538,403 | 7/1996 | Black | 417/253 |
| 5,577,892 | 11/1996 | Schittler et al. | 417/440 |

FOREIGN PATENT DOCUMENTS 0 481 964 A2 4/1992 European Pat. Off. .

*Primary Examiner*—Charles G. Freay
*Attorney, Agent, or Firm*—Edwin E. Greigg; Ronald E. Greigg

[57] ABSTRACT

A high pressure pump which has a working chamber, which on the one hand, is connected to a low pressure circuit via a solenoid valve and on the other hand, is connected to a high pressure reservoir via a check valve. The solenoid valve has a spring-loaded closing body, which cooperates with a valve seat and together with it, constitutes the check valve. When the magnet is without current, the check function of the closing body is switched off via a valve tappet of the solenoid valve so that even with an initial working stroke of the high pressure pump, the connection to the low pressure circuit is maintained. Only with a supply of current to the solenoid valve executed during the working stroke does the valve tappet allow the closing body to contact its valve seat, whereupon the high pressure delivery then begins. The high pressure pump is designated for use in fuel injection systems of diesel motor vehicle engines.

5 Claims, 2 Drawing Sheets

HIGH PRESSURE PUMP WITH SOLENOID OPERATED VALVE

BACKGROUND OF THE INVENTION

The invention relates to a high pressure pump as set forth in EP 0 481 964 A2.

High pressure pumps of this kind are used for fuel injection in diesel engines. They are disposed between a low pressure container and a high pressure reservoir (rail) and ensure that there is a satisfactory quantity of fuel at a sufficient high pressure in the high pressure chamber in order to supply fuel to the working cylinders of the engine in a controlled manner via injection valves.

In the known high pressure pump, a solenoid valve, which is open when without current, is disposed between the low pressure container and the pump cylinder. It is closed by a current pulse to establish the beginning of the high pressure delivery. Otherwise, it remains unexcited. To close the solenoid valve, relatively intense forces must be brought to bear by the magnet, wherein the force of the valve spring that counteracts the closing must be overcome. As a result, the cost and current requirement of the magnet are relatively high.

In conventional injection systems with parallel supply of a number of pump working chambers from the low pressure circuit, there is already a so-called suction throttle regulation in which the pump is operated with variable partial guidance. However there is the danger of cavitation through the formation of voids, and in addition, a very rapid pressure buildup is produced at the onset of delivery.

Similar disadvantages also arise in a suction throttle regulation when a solenoid valve and with it a solenoid valve metering are used instead of the throttle.

OBJECT AND SUMMARY OF THE INVENTION

The disadvantages demonstrated are rectified according to the invention through the features set forth hereinafter. With a high pressure pump of the kind mentioned at the beginning, this has the advantage that only a small and inexpensive valve is required as the solenoid valve, without impairing the reliability of the device.

Advantageous improvements of the invention ensue from the features set forth herein as well as from the description and the drawings. Accordingly, it is advantageous that an excessive pressure in the high pressure container can be avoided by means of the connecting conduit, which is opened in the top dead center. A pressure limiting of this kind can protect against damage when there is a malfunction in the system.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
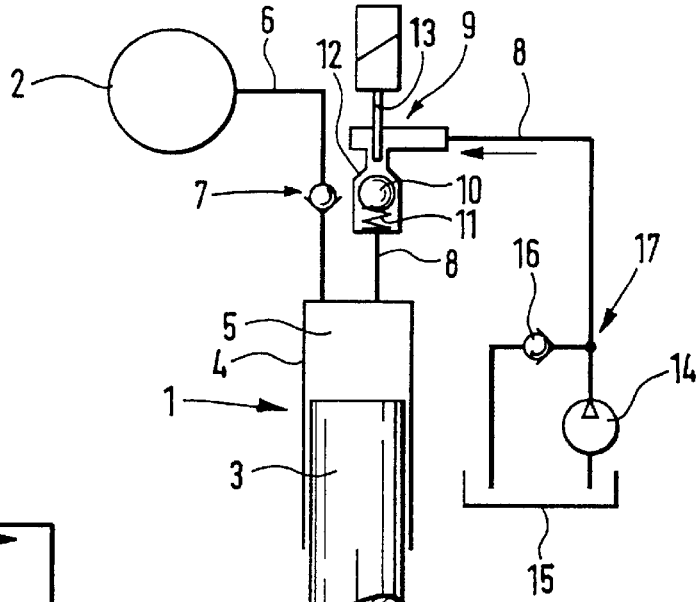
FIG. 1 shows a first embodiment of the high pressure pump in the intake stroke.

A high pressure pump 1 is used as a diesel injection pump and is designated to fill a high pressure reservoir 2 (also called a rail). The high pressure reservoir 2 is connected to injection valves, not shown, via which the working cylinders of an internal combustion engine is provided in a manner likewise not shown with precisely metered quantities of diesel fuel.

The high pressure pump 1 has a pump piston 3, which can be set into reciprocating motion in a pump cylinder 4 via a tappet, not shown, and as a movable wall, defines a working chamber 5 of the high pressure pump 1. A high pressure line 6 leads from the working chamber 5 to the high pressure reservoir 2; a check valve 7 that opens in the direction of the high pressure reservoir 2 is inserted into this high pressure line 6.

With regard to the current invention, an inlet line 8 is guided to the working chamber 5 and a solenoid valve 9 is inserted into it so that the valve closing body 10, which is embodied as a ball, can be lifted up from its valve seat 12 counter to the force of a valve spring 11 solely by the suction pressure in the inlet line 8. In this manner, the closing body 10, valve spring 11, and valve seat 12 constitute an independent check valve. The action of the magnet armature of the solenoid valve 9, which action is not shown, is connected to a valve tappet 13, which can be moved downward under magnetic force and then holds the closing body 10 away from its valve seat 12.

Furthermore, the device also includes a low pressure pump 14, a low pressure container 15, and a check valve or low pressure limiting valve 16 in a low pressure circuit 17.

Operation of the Pump

FIG. 1 shows the high pressure pump 1 in the intake stroke. Fuel from the low pressure circuit 17 travels via the inlet line 8 (arrow direction) and the valve closing body 10, which is lifted up from its valve seat 12 counter to the force of the valve spring 11, and arrives in the working chamber 5. The solenoid valve 9 is shown without current.

Figure 2:
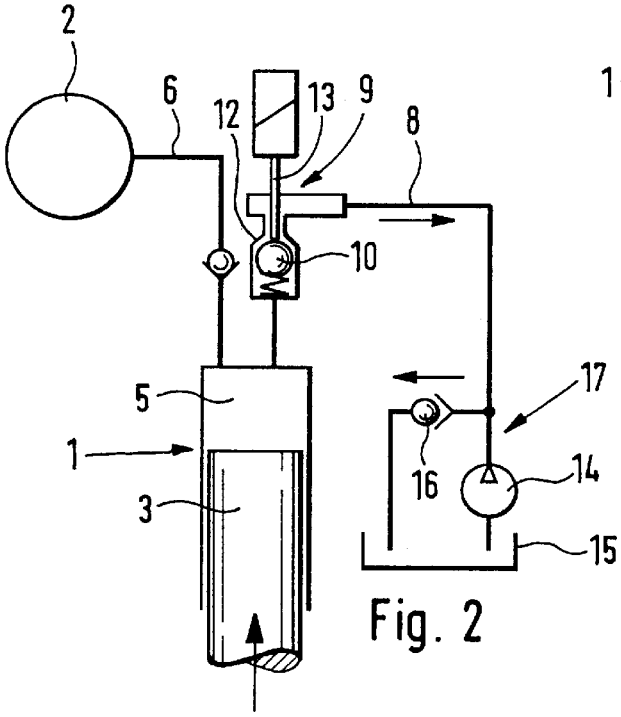
FIG. 2 shows the high pressure pump according to FIG. 1, before the onset of delivery.

If the pump piston 3 has reached its bottom dead center UT, then its movement direction is reversed. This moment before the onset of delivery of the high pressure pump 1 is represented in FIG. 2 using the same reference numerals as in FIG. 1. The magnet of the solenoid valve 9 is supplied with current, the valve tappet 13 moves against the valve closing body 10 and holds it away from its valve seat 12. A part of the aspirated fuel is supplied by the pump piston 3 of the high pressure pump 1 from the working chamber 5 via the inlet line 8 back to the low pressure circuit 17 (arrow direction) and from there, via the check valve 16 into the low pressure container 15.

Figure 3:
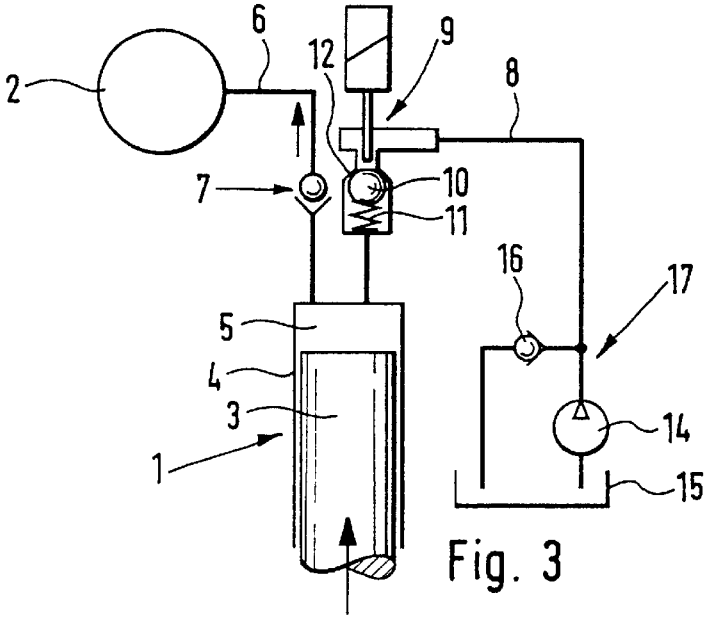
FIG. 3 shows the high pressure pump according to FIG. 1, after the onset of delivery.
Figure 4:
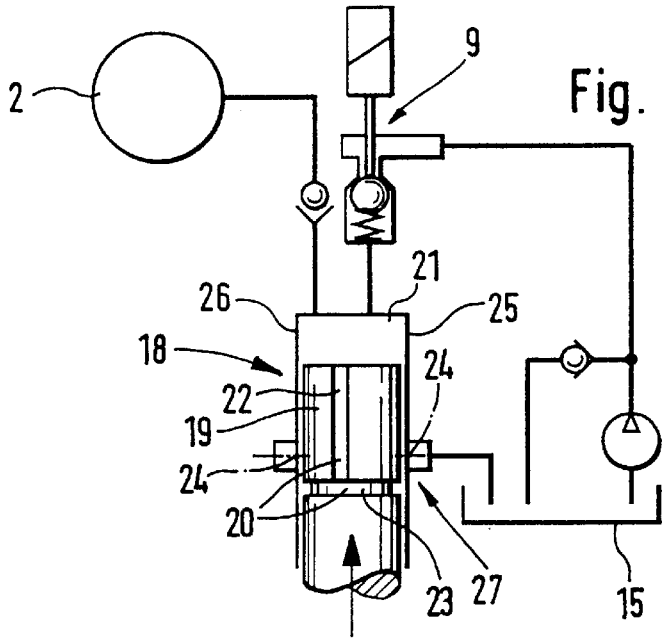
FIG. 4 shows another embodiment of the high pressure pump.

If in its ensuing path, the pump piston 3 has traveled a stroke in the feed direction, which stroke is determined by the rotational angle of the cam shaft, then the solenoid valve 9 is switched into a currentless state. As represented in FIG. 3, the closing body 10 reaches its valve seat 12 under the influence of the valve spring 11 force and under the influence of flow forces. The solenoid valve is closed. In the working chamber 5 of the high pressure pump 1, the pressure increase begins and diesel fuel is supplied via the opening check valve 7 and via the high pressure line 6 (arrow direction) into the high pressure reservoir 2. The low pressure pump 14 feeds into the low pressure circuit 17.

With the described manner of function, the high pressure pump 1 designed according to the invention has the following advantages: a relatively small and simple magnet is sufficient in order to hold the valve closing body 10, which is already lifted by the fluid flow, in its open position.

A change in delivery quantity can easily be carried out by means of the rapid response of the pressure regulation when the solenoid valve 9 closes.

There are no control edges. As a result of greater overlap length, there are also only very slight leakages.

Also, the design of the high pressure pump 1 is distinguished by simplicity in that neither a connecting rod regulation, a control edge, a control bore, nor an actuating magnet for a position regulating circuit is required. Furthermore, the tappet for the high pressure pump 1 can be mounted from above. Also, the high pressure pump 1 can be embodied without a bottom closure.

Finally, when switching over, there is no pressure surge and as a result, there is also no cavitation.

Using the same reference numerals for parts that correspond to the embodiment according to FIGS. 1 to 3, FIG. 4 shows a different version of a high pressure pump 18. However, the high pressure side and the low pressure side are embodied exactly the same as in the version according to FIGS. 1 to 3. Here, a pump piston 19 is provided with a connecting conduit 20 via which in the top dead center OT, i.e. at the end of the feed stroke, a connection is produced between a working chamber 21 of the high pressure pump 18 and the low pressure container 15.

In particular, the connecting conduit 20 is comprised of a longitudinal conduit 22 and an annular groove 23 in the pump piston 19. The annular groove 23, together with a bore 24 in the wall 25 of a pump cylinder 26, constitutes a spool-type valve 27 by virtue of the fact that the edges of the annular groove 23 overshoot the mouth of the bore 24 in the wall 25 of the pump cylinder 26. The manner of function of this version differs from the one according to FIGS. 1 to 3 by virtue of the fact that this one permits a metering for the high pressure reservoir 2 and a diversion before the top dead center. In addition, a greater diameter of the pump piston is conceivable.

Figure 5:
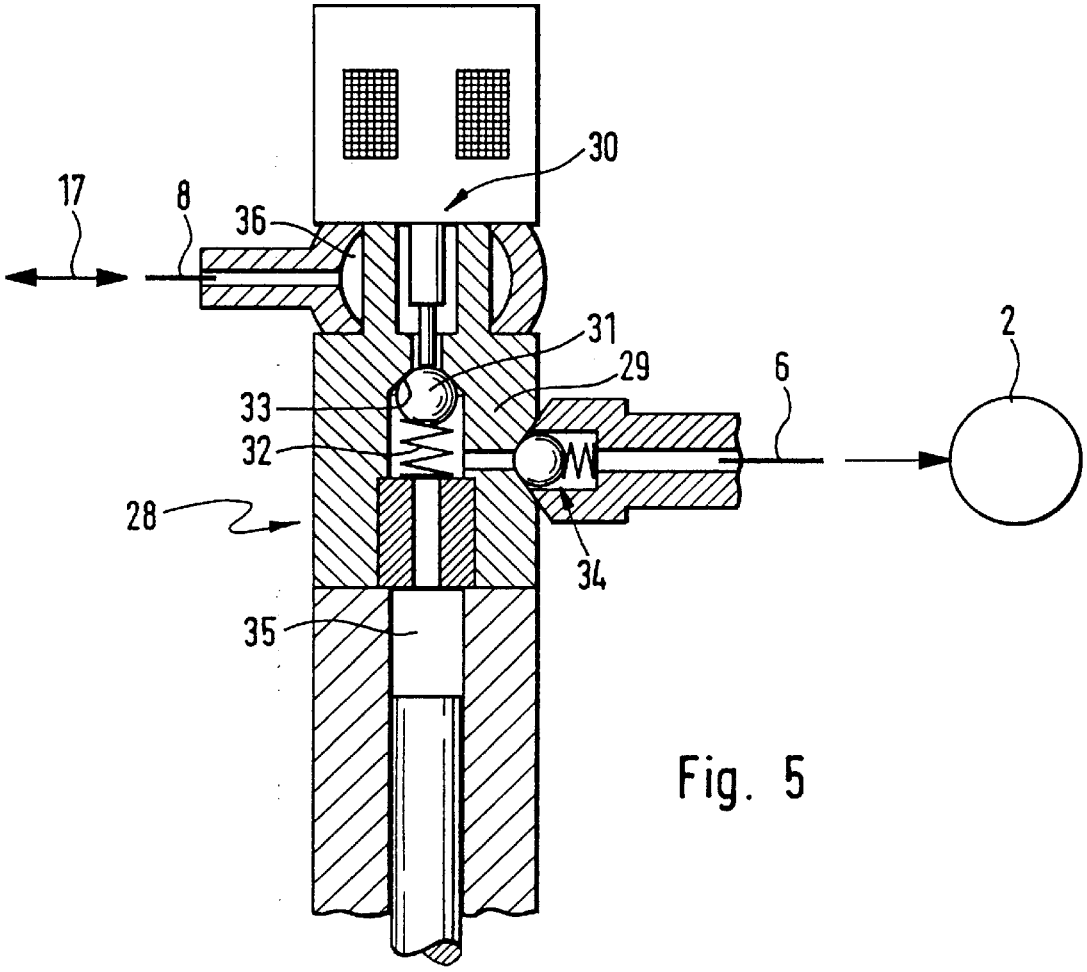
FIG. 5 shows a second version of the high pressure pump.

Finally, FIG. 5 shows a version with a high pressure pump 28, which does not have any separate fuel connection. In a pressure valve combination 29, a combined solenoid valve 30 having a closing body 31, a valve spring 32, and a valve seat 33, is united with a check valve 34, and this pressure valve combination is connected to a working chamber 35 of the high pressure pump 28. The check valve 34 monitors the high pressure line 6 to the high pressure reservoir 2, and on the solenoid valve 30, an annular connection 36 is provided that is connected to the low pressure circuit 17. In its manner of function, this version is equal to the one according to FIGS. 1 to 3, so an additional description is not required.

The foregoing relates to preferred exemplary embodiments of the invention, it being understood that other variants and embodiments thereof are possible within the spirit and scope of the invention, the latter being defined by the appended claims.

I claim:

1. A high pressure pump for fuel injection for diesel engines, comprising a pump cylinder (4, 26), a tappet-operated pump piston (3, 19), said pump piston moves in reciprocation in said pump cylinder (4, 26), a solenoid valve (9, 30) in a low pressure line (17), said solenoid valve comprises in combination (16) with a closing body (31) a magnet, a magnet armature connected to a valve tappet (13) and a fit check valve, said check valve controls both an influx of fuel from a low pressure circuit (17) to a working chamber (5, 21, 35) in the pump cylinder (4, 26) and a return flow of fuel from the working chamber (5, 21, 35) to the low pressure circuit (17), a high pressure fuel line (6) from said working chamber to a high pressure reservoir, a second check valve (7, 34) inserted into said high pressure fuel line (6), that an onset of high pressure delivery of the high pressure pump (1, 18, 28) initiated by de-energizing the magnet of the solenoid valve (9, 30) to permit said closing body of said solenoid valve to close.

2. A high pressure pump according to claim 1, in which said closing body (31) is operative in a fuel chamber that communicates with said working chamber (35), said fuel chamber communicates with said low pressure line (17) and said high pressure fuel line (6) via said second check valve (34) which is connected with said fuel chamber and connects said working chamber (35) of a high pressure pump 28 with said high pressure fuel line (6).

3. A high pressure pump according to claim 2, in which the low pressure circuit (17) is connected to the fuel chamber via an annular connection (36).

4. A high pressure pump for fuel injection for diesel engines, comprising a pump cylinder (26), a tappet-operated pump piston (19), said pump piston moves in reciprocation in said pump cylinder (26), a solenoid valve, in a low pressure line (17), said solenoid valve comprises in combination, a closing body (10) a magnet, a magnet armature connected to a valve tappet (13) and a first check valve (16), said check valve controls both an influx of fuel from a low pressure circuit (17) to a working chamber (21) in the pump cylinder (26) and a return flow of fuel from the working chamber (21) to the low pressure circuit (17), a high pressure fuel line (6) from said working chamber to a high pressure reservoir, a second check valve (7) inserted into said high pressure fuel line (6), said closing body (10) of the solenoid valve (9), is held in the valve open position by said valve tappet (13) of the solenoid valve (9) when the magnet is supplied with current, and that an onset of high pressure delivery of the high pressure pump (18) is initiated by de-energizing the magnet of the solenoid valve (9) to close said closing body (10) of said solenoid valve, and a connecting conduit (20) is provided in the pump piston (19), said connecting conduit forms a connection between the working chamber (21) of the high pressure pump (18) and a low pressure reservoir (15) of the low pressure circuit (17) in the top dead center of the pump piston at an end of delivery.

5. A high pressure pump according to claim 4, in which the connecting conduit (20) is comprised of at least one longitudinal conduit (22) and an annular groove (23) in the pump piston (19) and that the connection of the working chamber (21) with the low pressure reservoir (15) is produced by a spool-type valve which is constituted by edges of the annular groove (23) and a bore (24) in a wall (25) of the pump cylinder (26).

* * * * *